US009580976B1

(12) United States Patent
Grubelich et al.

(10) Patent No.: US 9,580,976 B1
(45) Date of Patent: Feb. 28, 2017

(54) DEPLOYABLE CENTRALIZERS

(71) Applicant: Sandia Corporation, Albuquerque, NM (US)

(72) Inventors: Mark C. Grubelich, Albuquerque, NM (US); Jiann-Cherng Su, Albuquerque, NM (US); Steven D. Knudsen, Stanley, NM (US)

(73) Assignee: Sandia Corporation, Albuquerque, NM (US)

( * ) Notice: Subject to any disclaimer, the term of this patent is extended or adjusted under 35 U.S.C. 154(b) by 360 days.

(21) Appl. No.: 14/195,986

(22) Filed: Mar. 4, 2014

Related U.S. Application Data

(60) Provisional application No. 61/785,527, filed on Mar. 14, 2013.

(51) Int. Cl.
*E21B 17/10* (2006.01)

(52) U.S. Cl.
CPC ..... *E21B 17/1028* (2013.01)

(58) Field of Classification Search
CPC .. E21B 17/10; E21B 17/1014; E21B 17/1021; E21B 17/1028; E21B 17/1064
See application file for complete search history.

(56) References Cited

U.S. PATENT DOCUMENTS 3,978,924 A * 9/1976 Roesner ..... E21B 17/1021 166/241.5
5,238,062 A 8/1993 Reinholdt
5,261,488 A * 11/1993 Gullet ..... E21B 17/1028 166/241.7
5,287,920 A * 2/1994 Terrell ..... E21B 17/1021 166/212
2010/0175888 A1 7/2010 Buytaert et al.

* cited by examiner

*Primary Examiner* — Brad Harcourt
(74) *Attorney, Agent, or Firm* — Daniel J. Jenkins

(57) ABSTRACT

A centralizer assembly is disclosed that allows for the assembly to be deployed in-situ. The centralizer assembly includes flexible members that can be extended into the well bore in situ by the initiation of a gas generating device. The centralizer assembly can support a large load carrying capability compared to a traditional bow spring with little or no installation drag. Additionally, larger displacements can be produced to centralize an extremely deviated casing.

5 Claims, 2 Drawing Sheets

DEPLOYABLE CENTRALIZERS

CROSS-REFERENCE TO RELATED APPLICATIONS

This application claims benefit of U.S. Provisional Patent Application No. 61/785,527, "DEPLOYABLE CENTRALIZERS", filed Mar. 14, 2013, which is incorporated by reference herein in its entirety.

STATEMENT OF GOVERNMENT INTEREST

The United States Government has rights in this invention pursuant to Contract No. DE-AC04-94AL85000 between the United States Department of Energy and Sandia Corporation, for the operation of the Sandia National Laboratories.

FIELD

The present invention relates to the field of drilling, and specifically to a centralizer that is deployed in a retracted position and that can be deployed in situ.

BACKGROUND

Down-the-hole (DTH) drills are used for oil drilling, natural gas, geothermal drilling, and other deep earth penetration applications. For nearly any drilling method, a casing is inserted into well bore. During cementing operations, it is desirable to centralize the casing in the well bore, assuring a competent cement seal. Bow spring centralizers are the primary method of centralizing the casing. They are designed to be easily attached to the casing as it is run, and have a limited centralizing force to because of the tradeoff required for minimizing insertion drag. The design features that make them easy to use also contribute to their limitations, namely a limit to the deflection force generating capabilities. This can compromise the cement job due to variation in cement thickness caused by a lack of concentricity between the casing and the well bore. Additionally with modern horizontal and slope drilling and casing, the centralizers must exert enough force to support the weight of the casing.

What is needed is a centralizer system and method that overcomes the limitations of the prior art.

Other features and advantages of the present invention will be apparent from the following more detailed description of the preferred embodiment, taken in conjunction with the accompanying drawings which illustrate, by way of example, the principles of the invention.

SUMMARY

According to an embodiment of the invention, a centralizer assembly is disclosed that includes a first sleeve, a second sleeve, and a plurality of flexible members disposed between and connecting the first and second sleeves. The first sleeve includes a housing, a gas generating device contained within the housing, and a slide member at least partially contained within the housing. The gas generating device is capable of generating an applied force upon the slide member thereby extending the slide member away from the housing so as to cause the plurality of flexible members to pivot in a direction away from the direction of the applied force.

According to another embodiment of the invention, a method of centralizing a casing in a well bore is disclosed that includes attaching a centralizer assembly comprising flexible members to the casing and initiating a gas generating material within the centralizer assembly that generates a force extends that extends the flexible members towards the well bore Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 2:
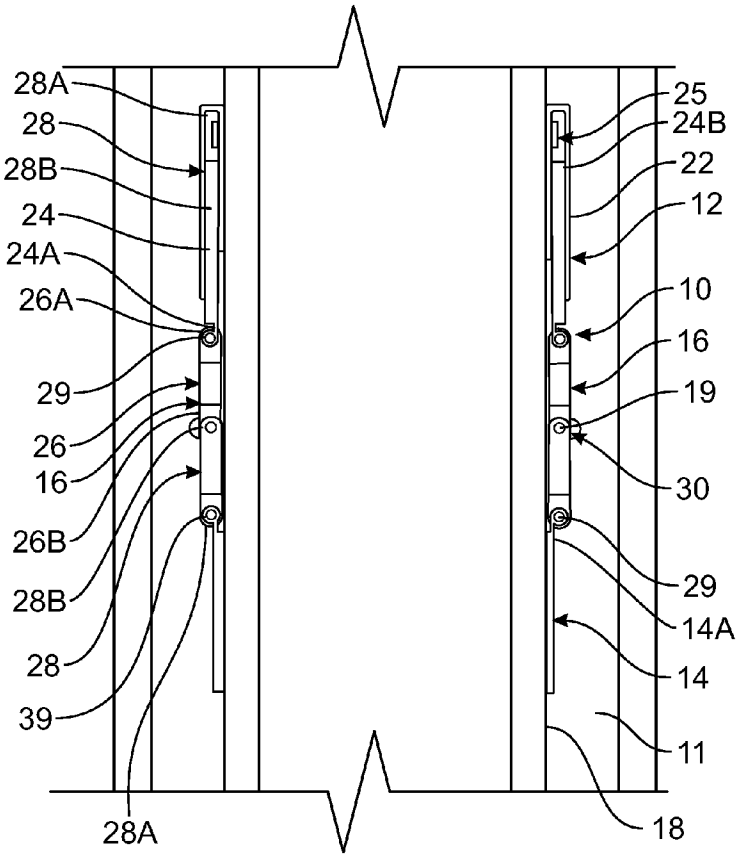
FIG. 2 shows a side cut away view of the centralizer of FIG. 1 deployed in a portion of a well bore.
Figure 1:
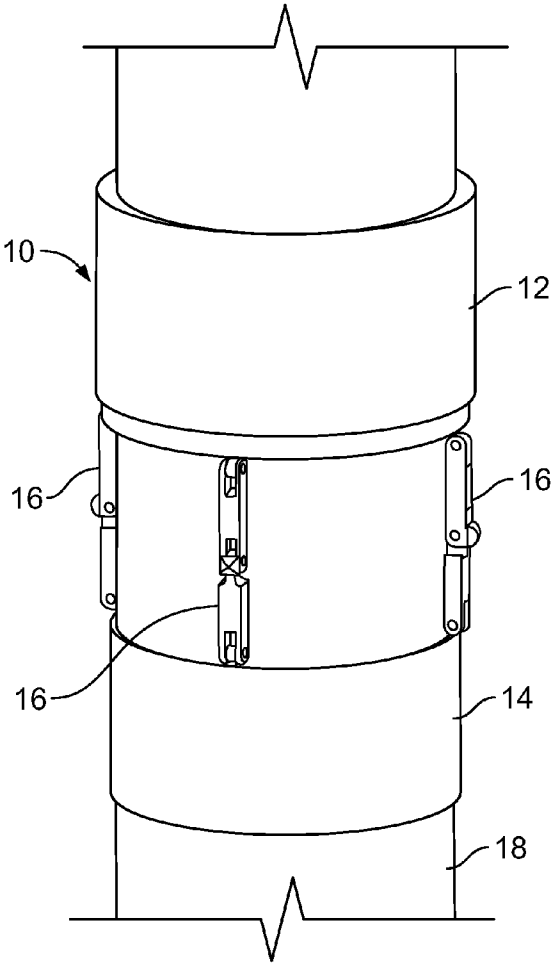
FIG. 1 illustrates an embodiment of a centralizer assembly in an initial, retracted position attached to a portion of a well casing according to an embodiment of the disclosure.

FIGS. 1 and 2 illustrate an embodiment of a centralizer assembly 10 according to the disclosure. FIGS. 1 and 2 show the centralizer assembly 10 in an initial, retracted position. In FIG. 2, the centralizer assembly 10 is shown in a portion of a well bore 11. As can be seen in FIGS. 1 and 2, the centralizer assembly 10 includes a first sleeve 12, a second sleeve 14, and flexible members 16. The first and second sleeves 12, 14 are rigidly attached to a portion of a well casing 18. The term "rigidly attached" as used herein means that the first and second sleeves 12, 14 are attached to the casing 18 in such a manner as to not move axially along the length axis of the casing 18. In this exemplary embodiment, the first and second sleeves 12, 14 are attached to the well casing (casing) 18 by welding. In another embodiment, the first and second sleeves 12, 14 may be rigidly attached to the well casing 18 by welding, brazing or the use of fasteners. Also in this exemplary embodiment, the centralizer assembly 10 includes 4 flexible members (a centralizer assembly 10 is present, but not shown on the opposite side of the well casing 18 shown in FIG. 1). In another embodiment, the centralizer assembly 10 may include two or more flexible members 16.

As can be seen in FIG. 2, the first sleeve 12 includes an outer housing 22, a slide portion 24 and an energetic device 25. It is the housing 22 of the first sleeve 12 that is rigidly attached to the casing 18 to rigidly attach the first sleeve 12 to the casing 18. The housing 22 includes a chamber portion 28 that includes a first chamber portion 28A containing the energetic device 26 and a second chamber portion 28B that at least partially contains the slide portion 24. The slide portion 24 includes a first end 24A and a second end 24B. The second end 24B abuts the first chamber portion 28A.

The energetic device 25 includes an energetic material (not shown). The energetic material is a material capable of generating a gas or expanding upon initiation. In an embodiment, the energetic material may be selected from a group including, but not limited to paraffin actuators, shape memory alloys, energetic gas generator materials. Energetic gas generating materials include a broad class of pyrotechnics, propellants and explosive materials, including, but not limited to, single, double and triple based nitrocellulose based propellants, air bag inflating materials based on sodium azide, high nitrogen gas producing energetics, composite propellants based on synthetic polymer binders and nitrates, chlorates or perchlorate oxidizers, such as, but not limited to ammonium nitrate and ammonium perchlorate, plastisol propellants, and explosives, such as, but not limited to RDX, HMX, HNS, PXY. The energetic material may be initiated or ignited by any ignition source (not shown), such as a mechanical, electrical, optical or thermal source. The ignition source may be triggered by a signal that is either wired, fiber optically coupled or wirelessly connected to the energetic device 25.

The flexible members 16 include a first portion 26 a second portion 28. The first portion 26 includes a first end 26A and a second end 26B. The second portion 28 includes a first end 28A and a second end 28B. The second end 26B of the first portion 26 is attached to the second end 28B of the second portion 28 by a pin 19 at joint 30. In another embodiment, the two second ends 26B, 28B may be attached to on another by a pin, protrusion, joint or other fastener that allows the two second ends 26B, 28B to rotate or bend relative to the one another and away from the casing 18. For example, a joint may include a material that can be plastically deformed. In an embodiment, the joint may include a material that can be permanently plastically deformed.

The first end 26A of first portion 26 is attached to a first end 24A of the slide portion 24 by pin 29. In another embodiment, the first end 26A may be attached to the first end 24A by a pin, protrusion, joint or other fastener that allows the first portion 26 to rotate or bend relative to the slide portion 24 and away from the casing 18.

The first end 28A of the second portion 28 is attached to the first end 14A of the second sleeve 14 by pin 39. In another embodiment, the first end 28A may be attached to the first end 14A by a pin, protrusion, joint or other fastener that allows the second portion 28 to rotate or bend relative to the second sleeve 14 and away from the casing 18.

Figure 4:
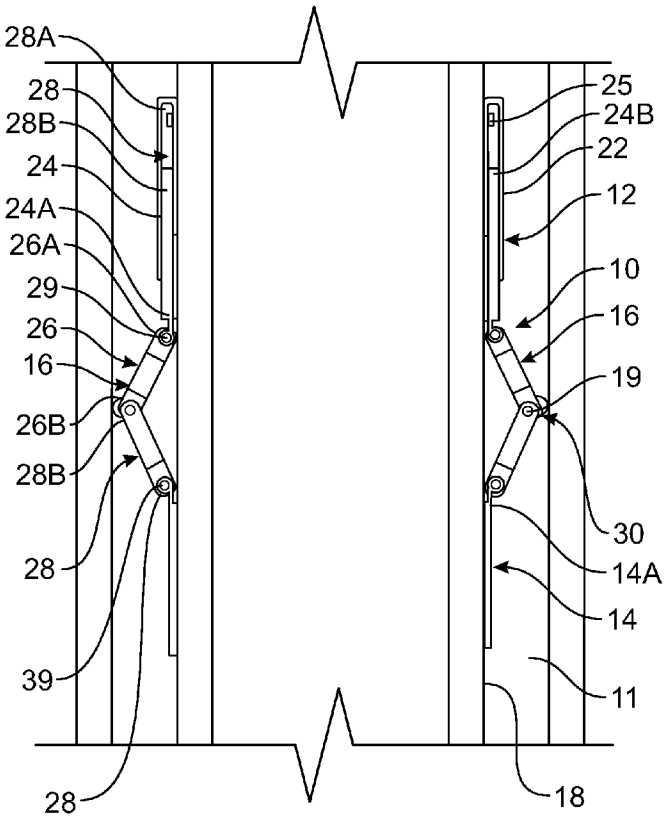
FIG. 4 shows a side cut away view of the centralizer of FIG. 3 deployed in a portion of a well bore.
Figure 3:
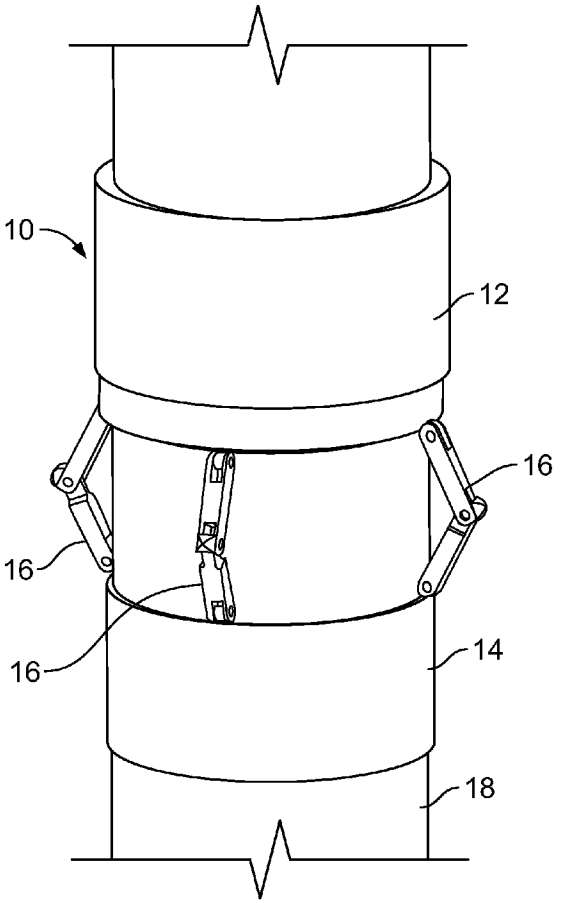
FIG. 3 illustrates an embodiment of a centralizer assembly in an installed, deployed position attached to a portion of a well casing according to an embodiment of the disclosure.

FIGS. 3 and 4 show the centralizer assembly 10 in an installed, deployed position. In FIG. 4, the centralizer assembly 10 is shown in well bore 11. As can be seen in FIGS. 3 and 4, the centralizer assembly 10 has been deployed by initiating the energetic device 25 so as to generate a gas that expands the volume of first chamber 28A and decreases the volume of second chamber 28B, which partially contains slide member 24. In another embodiment, the energetic device has been initiated to generate a gas or material that expands the volume of the first chamber 28A. The volume of the first chamber 28A is increased by the generated gas exerting pressure and thus an applied force on slide member 24 in the direction of the flexible members 16, thereby forcing or pushing slide member 24 out of the housing 22 and towards the flexible members 16.

The force exerted on the flexible members 16 by the slide member 24 causes the flexible members 16 to pivot or flex at joint 30 away from the casing 18. In this exemplary embodiment, the first and second portions 26, 28 are not deformable by the pressure exerted by the slide member 24. In another embodiment, the first and/or second portions 26, 28 may be deformed by the pressure exerted by the slide member 24. The joint 30 is configured to not move back towards the casing 18 after being deployed by pressure generated in first chamber 28A. In an embodiment, the joint 30 may be configured so as to provide a fixed, angled joint when flexed so as to not move back towards the casing 18. In an embodiment, the joint 30 is configured to not move back towards the casing 18 after being deployed by a center mechanism that locks in place or creates an interference fit. In another embodiment, the joint 30 may be configured to not move back towards the casing 18 by an index positioner or other ratcheting type lock that allows deployment but not reverse motion.

In another embodiment, the centralizer assembly 10 may include a sensor (not shown) that indicates to an operator if the centralizer assembly 10 is deployed.

The disclosed centralizer assembly 10 and method of deployment allows the centralizer assembly to support a large load carrying capability compared to a traditional bow spring with little or no installation drag. Additionally, larger displacements can be produced to centralize a casing in an extremely deviated borehole.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of positioning a casing in a well bore, comprising attaching a centralizer assembly comprising flexible members to the casing; and initiating a gas generating material within the centralizer assembly that generates a force extends that extends the flexible members towards the well bore;

wherein the centralizer assembly comprises:

a first sleeve comprising a housing, a gas generating device contained within the housing, and a slide member at least partially contained within the housing;

a second sleeve; and a plurality of flexible members disposed between and connecting the first and second sleeves; and wherein the gas generating device is capable of generating an applied force upon the slide member thereby extending the slide member away from the housing so as to cause the plurality of flexible members to pivot in a direction away from the direction of the applied force; and wherein the housing and second sleeve are rigidly attached to the casing.

2. The method of claim 1, wherein the gas generating material comprises an energetic material selected form a group consisting of paraffin actuators and energetic gas generator materials.

3. The method of claim 1, wherein a flexible member of the plurality of flexible members comprises:

a first member; and a second member pivotally connected to the first member portion.

4. The method of claim 3, wherein the second member is pivotally connected to the first member by a pin.

5. The method of claim 3, wherein the first and second members are not deformed by the applied force pivoting the first and second members in a direction away from the direction of the applied force.

* * * * *